US006439948B1

(12) United States Patent
Ostendorff et al.

(10) Patent No.: US 6,439,948 B1
(45) Date of Patent: Aug. 27, 2002

(54) TWO-WHEELED AMPHIBIOUS TOY VEHICLE

(75) Inventors: Eric Ostendorff, Torrance; Helena Bartor, Signal Hill; Nathan C. Proch, Los Angeles, all of CA (US)

(73) Assignee: Mattel, Inc., El Segundo, CA (US)

( * ) Notice: Subject to any disclaimer, the term of this patent is extended or adjusted under 35 U.S.C. 154(b) by 213 days.

(21) Appl. No.: 08/914,477

(22) Filed: Aug. 19, 1997

(51) Int. Cl.[7] ..... A63H 23/04

(52) U.S. Cl. ..... 446/154; 446/462; 446/465; 446/431

(58) Field of Search ..... 446/462, 465, 446/431

(56) References Cited

U.S. PATENT DOCUMENTS

| | | | | |
|---|---|---|---|---|
| 1,868,313 A | * | 7/1932 | Daubendiek | |
| 2,064,309 A | * | 12/1936 | Lohr | |
| 2,977,714 A | | 4/1961 | Gibson | |
| 3,192,664 A | * | 7/1965 | Travers | |
| 3,313,365 A | | 4/1967 | Jackson | |
| 3,445,959 A | * | 5/1969 | Barlow et al. | |
| 3,590,526 A | | 7/1971 | Deyerl et al. | |
| 3,733,739 A | * | 5/1973 | Terzian | |
| 3,785,085 A | * | 1/1974 | Peroni | |
| 4,107,872 A | * | 8/1978 | Tucker et al. | |
| 4,209,942 A | * | 7/1980 | Lohr | |
| 4,213,270 A | | 7/1980 | Oda | |
| 4,310,987 A | | 1/1982 | Chieffo | |
| 4,346,893 A | | 8/1982 | Landsinger et al. | |
| 4,508,516 A | * | 4/1985 | D'Andrade et al. | 446/454 |
| 4,705,487 A | | 11/1987 | Ishimoto | |
| 4,897,070 A | | 1/1990 | Wagstaff | |
| 4,902,260 A | | 2/1990 | Im | |
| 5,135,427 A | | 8/1992 | Suto et al. | |
| 5,145,442 A | | 9/1992 | Zan | |
| 5,173,073 A | * | 12/1992 | Franzone | 446/465 |
| 5,273,480 A | | 12/1993 | Suto | |
| 5,667,420 A | * | 9/1997 | Menow et al. | 446/456 |
| 5,727,985 A | * | 3/1998 | George et al. | 446/456 |

* cited by examiner

*Primary Examiner*—Derris H. Banks
*Assistant Examiner*—Dmitry Suhol
(74) *Attorney, Agent, or Firm*—Roy A. Ekstrand

(57) ABSTRACT

An elongated substantially hollow body supports a pair of motor drive units, a battery power supply, and a radio frequency receiver and controller module. A pair of axles are rotatably supported near the frontal end of the elongated body and in turn support a pair of large diameter wheels. The motor drive units within the body are operatively coupled to the axles and are able to differentially drive the wheels. The position of the axles and wheels near the frontal portion of the vehicle results in the extension of a substantially greater portion of the body away from and beyond the wheels. Thus the extending portion of the body defines a trailing end. A control transmitter provides independent operational signals to each of the motor drive units to differentially drive the wheels. Each time the direction of travel of the toy vehicle is reversed, the reaction torque applied by the motors to the body causes the body to flip about the axles and invert bringing the trailing end to the opposite side of the wheels. By skillful manipulation of the controls, various tricks and stunts may be performed by the toy vehicle. The toy vehicle is also operable in an aquatic environment utilizing the wheels as paddle wheels for propulsion.

6 Claims, 5 Drawing Sheets

TWO-WHEELED AMPHIBIOUS TOY VEHICLE

FIELD OF THE INVENTION

This invention relates generally to toy vehicles and particularly to those which are self-powered and remotely controlled by an operator using a transmitter to communicate commands to a receiver within the toy vehicle.

BACKGROUND OF THE INVENTION

Toy vehicles have proven to be a long-lasting and extremely popular category of toys. Not surprisingly, in response to this long term popularity, practitioners in the toy arts have provided a virtually endless variety of toy vehicles. As a result, toy vehicles have been provided which are free-wheeling, unpowered vehicles moved by hand as well as toy vehicles having spring-powered or wind-up apparatus. Still other toy vehicles have relied upon inertia power to store energy within a rotating flywheel which then drives the vehicle for a significant distance. By far the most popular type of powered toy vehicle however has proven to be the electrically powered vehicle in which a battery power source within the vehicle operates one or more small electric motors operatively coupled to one or more of the vehicle wheels. A latter refinement of such battery powered toy vehicles provided so-called remote controlled or RC toy vehicles.

Remote controlled toy vehicles have been provided using various types of energy for communicating commands to the toy vehicle. While such vehicles vary greatly in design, the basic elements of the vehicle system are usually in that a plurality of batteries provide energy to one or more drive motors for propelling the vehicle and also provide operative power to an electronic control module supported within or on the vehicle. The control module is capable of altering the operating characteristics of the vehicle such as the speed, direction, and steering of the vehicle. A communication receiver is stored on or in the vehicle and is operatively coupled to the control system for receiving operating commands from a remote transmitter which the user manipulates to remotely control the vehicle by communicating commands to the receiver thereon. This communication has taken place using radio frequency energy, sound or ultrasound, or light energy such as infrared energy. Each of these energy forms has distinct advantages and disadvantages. However the dominant communication system for vehicles having any complexity of operation is generally reliant upon radio frequency transmitted commands.

In addition to the great variation of systems used in remote controlled toy vehicles, the vehicles themselves have varied greatly in structure and appearance. The appearance of such vehicles has varied from realistic miniature versions of existing vehicles to fanciful or exaggerated appearances sometimes assuming a cartoon-like departure from reality. Other remote controlled toy vehicles have resembled animals exaggerated from the animal appearances or some sort of robotic/animal appearance.

Despite all this effort directed toward producing a variety of remotely controlled toy vehicles, the actions of most, if not all, of such toy vehicles have been basically similar in that the vehicle is able to move, change direction, steer, or stop on command providing action basically similar to all other remote controlled vehicles. For example, U.S. Pat. No. 3,590,526 issued to Deyerl et al sets forth a REMOTELY STEERABLE VEHICLE providing a self-propelled toy vehicle adapted for use on a track or other surface wherein its steering and speed may be controlled by electromechanical or electronic means. A pair of motors are independently coupled to a corresponding pair of drive wheels and are operated differentially to provide steering and propulsion for the toy vehicle.

U.S. Pat. No. 4,213,270 issued to Oda sets forth a RADIO CONTROLLED WHEEL TOY having a battery power apparatus controlled by a remotely located hand-held transmitter. The toy vehicle supports two motors, each connected to drive one wheel of the front and rear wheel pairs. By controlling the current to the motors, their respective speed of rotation is controlled causing the toy car vehicle to turn left or right.

U.S. Pat. No. 4,902,260 issued to Im sets forth an AMPHIBIAN TOY CAR which may be operated by a remote controller. The toy vehicle includes wheels having projecting fins to provide amphibious capability when the vehicle enters water.

U.S. Pat. No. 5,135,427 issued to Suto et al sets forth a CATERPILLAR TYPE TOY VEHICLE having a vehicle body supporting larger rear wheels and smaller front wheels, each front and rear wheel supporting a respective endless belt caterpillar track. A pair of electric motors supported within the body independently drive the caterpillar track through separate gear reduction transmissions utilizing the rear wheels as drive wheels. The twin motors are radio controlled for separate and independent action. A remote transmitter communicates commands independently to each caterpillar track drive to enable the toy vehicle to drive in either direction, turn, or stop through combinations of commands.

U.S. Pat. No. 5,273,480 issued to Suto sets forth a CONTROL VEHICLE TOY DRIVE TRAIN FOR PIVOTING TURNS providing high speed and large torque performance. A motor gear driven by a radio controlled motor is coupled to first and second drive gears for independently driving left hand and right hand wheels. First and second intermediate gears cause the first and second drive gears to rotate at a lower speed. An idler gear provides meshing with one of the intermediate gears to cause the first and second drive gears to rotate in opposite directions.

U.S. Pat. No. 5,145,442 issued to Zan sets forth a MULTI PURPOSE SOLAR ENERGY OPERATED TOY VEHICLE having a plate resembling a ship which supports a solar panel array on its upper surface which is operatively coupled to a drive motor. The drive motor is further coupled to a rotatable axle which alternatively may secure a pair of paddle wheels for operation in water or a pair of drive wheels for operation on land.

U.S. Pat. No. 4,897,070 issued to Wagstaff sets forth a TWO WHEELED MOTORIZED TOY having a toy body supported by an axle extending through the body substantially above the body's center of gravity. Within the body a battery power source and drive motor are operatively coupled to the shaft to provide rotational power to the shaft. Each end of the shaft is coupled to a large diameter wheel rotated under power as the shaft is rotated by the drive motor. The drive motor and battery supply are positioned below the upwardly displaced shaft to provide a balance weight for the body maintaining it in a substantially upright position as the wheels rotate and the toy vehicle moves.

Apparatus similar to that set forth in U.S. Pat. No. 4,897,070 (above) is set forth in U.S. Pat. No. 2,977,714 issued to Gibson; U.S. Pat. No. 3,313,365 issued to Jackson; and U.S. Pat. No. 4,310,987 issued to Chieffo, all of which provide a two-wheeled vehicle having a center body weighted and balanced to maintain an upright position.

U.S. Pat. No. 4,705,487 issued to Ishimoto sets forth a MOVABLE TOY AUTOMATICALLY SWINGABLE BETWEEN AN UP POSITION AND A DOWN POSITION having an elongated toy body, a pair of driving wheels arranged at the bottom of the toy body, a pair of arms swingable from their vertical position to their forward horizontal position, a differential gear having an output shaft for forming a swing shaft of the arms, a driving motor and a gear train.

U.S. Pat. No. 4,346,893 issued to Landsinger et al sets, forth a REMOTE CONTROLLED SPORT GAME having a pair of figures operable on a playing surface, each figure having receivers tuned to different frequencies for operation by radio transmitters to control the movement of the figures.

While the foregoing described prior art devices have to some extent improved in the art, and in some instances, enjoyed commercial success, there remains nonetheless a continuing need in the art for evermore exciting, interesting and amusing remote controlled toy vehicles.

SUMMARY OF THE INVENTION

Accordingly, it is a general object of the present invention to provide an improved remotely controlled toy vehicle.

It is a more particular object of the present invention to provide an improved remotely controlled toy vehicle capable of a variety of actions and operational modes to provide improved interest for the user.

In accordance with the present invention, there is provided a toy vehicle comprising: an elongated body having a frontal end and a trailing end; a pair of wheels rotatably supported by the body substantially closer to the frontal end than the trailing end; and a pair of reversible motor drive units for applying a torque to each of the wheels and an opposite-direction reaction torque to the body, the reaction torque acting to flip the body pivoting the trailing end over the wheels when the motor drive units reverse the torque applied to the wheels.

The operation of the present invention toy vehicle is contemplated in a remotely controlled environment. Accordingly, the present invention provides a remotely controlled toy comprising: an elongated body having a front end and a trailing end; a pair of wheels rotatably supported by the body substantially closer to the frontal end and farther from the trailing end; drive means for independently rotating each of the wheels in either direction of rotation; and control means for operating the drive means in accordance with user commands.

In operation, the present invention toy vehicle is constructed to "flip" when direction of travel is reversed. The present invention toy vehicle comprises a toy vehicle comprising: an elongated body having a frontal end and a trailing end; a pair of wheels rotatably coupled to each side of the elongated body close to the frontal end such that the wheels extend beyond the frontal end and the trailing end extends well beyond the wheels; and means for independently and reversibly rotating the wheels to propel the toy vehicle, the toy vehicle moving in a first direction of motion as the wheels rotate in a first rotational direction such that the trailing end extends rearwardly with respect to the first direction of motion and the body pivoting when the wheels are reversed to a second opposite direction of rotation propelling the vehicle in a second opposite direction of motion to extend rearwardly with respect to the second direction of motion.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, and in which:

DESCRIPTION OF THE PREFERRED EMBODIMENT

Figure 1:
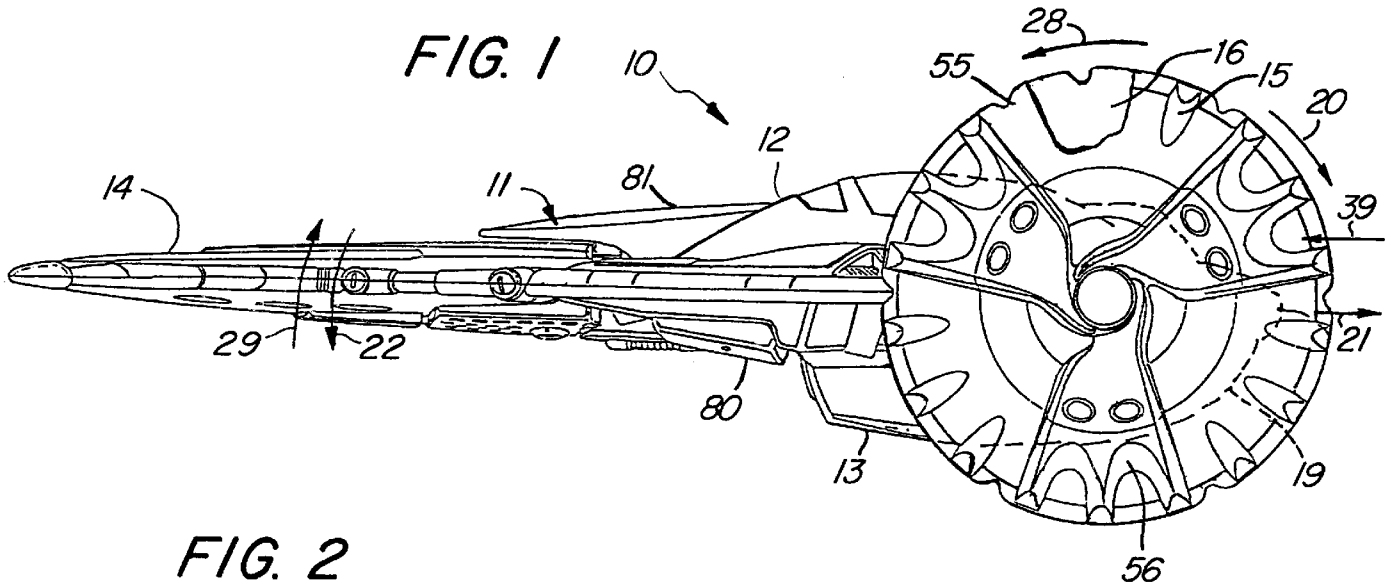
FIG. 1 sets forth a side elevation view of a two-wheeled amphibious toy vehicle constructed in accordance with the present invention.

FIG. 1 sets forth a side elevation view of a toy vehicle constructed in accordance with the present invention and generally referenced by numeral 10. Toy vehicle 10 includes an elongated body 11 formed of a top half body 81 secured to a fitted and mating bottom half body 80. Half body 81 defines a top side 12 while half body 80 defines a bottom side 13. Top side 12 and bottom side 13 are aesthetically contoured to present distinct appearances which represent machine-like features to provide the desired aesthetics for toy vehicle 10. It will apparent to those skilled in the art however that body 11 may be contoured and shaped to provide a variety of aesthetic appearances without departing from the spirit and scope of the present invention. For example, body 11 may be configured such that top side 12 and bottom side 13 define respective surfaces which have an animal-like character. By way of further alternative, top side 12 and bottom side 13 may be configured to represent a sea creature or sea monster. Still other aesthetic themes may be utilized for body 11. With respect to the present invention, the essential aspect of body 11 is the provision of a generally elongated body having a trailing end 14 and a frontal end 19. As is set forth below, body 11 is supported by a pair of independently driven wheels 15 and 16 (seen in FIG. 3).

In accordance with an important aspect of the present invention, wheels 15 and 16 are large diameter wheels which are displaced forwardly on body 11 such that the wheels' outer surfaces extend beyond frontal end 19. Correspondingly, trailing end 14 of body 11 extends well beyond the outer surfaces of wheels 15 and 16.

In operation, wheels 15 and 16 are capable of operation independently to provide differential power to propel toy vehicle 10 in either direction and along curved paths as well as subjecting vehicle 10 to violent spinning actions. For example, with wheels 15 and 16 turning in unison in a common direction, toy vehicle 10 moves in a straight line path accordingly. With either wheel rotating at a different speed than the other wheel, vehicle 10 moves along a curved path. In the event one wheel is stopped and the remaining wheel is driven, toy vehicle 10 undergoes a spinning movement about the static wheel. Further, if each wheel is rotated in an opposite direction, toy vehicle 10 is subjected to a violent high speed rotation.

Such differential steering of a vehicle by independently powered wheels is well-established in the art and utilized in several of the above-described prior art structures. However the present invention toy vehicle combines the differential drive to wheels 15 and 16 with the offset elongated shape of body 11 to provide a variety of additional actions and maneuvers not attainable with the prior art devices. Accordingly, and in accordance with an important aspect of the present invention, the opposite direction torque applied to body 11 as the differential drive motors (motors 111 and 121 seen in FIG. 5) rotate wheels 15 and 16 causes trailing end 14 to respond in a novel and unusual manner. To best understand the novel body flipping motion of body 11 as toy vehicle 10 is driven, a fundamental understanding of the torque and counter torque relationship between wheels 15 and 16 and body 11 is appropriate. Thus examining FIG. 1 and considering for the moment that wheels 15 and 16 are rotated in general unison in the direction indicated by arrow 20, toy vehicle 10 is propelled in the-direction indicated by arrow 21 in a generally straight line path. As the drive motors within body 11 apply a rotational torque to wheels 15 and 16 in the clockwise direction indicated by arrow 20, they also apply an opposite direction counterclockwise torque upon body 11 in the direction indicated by arrow 22. This torque together with the offset center of gravity of body 11 results in the travel of toy vehicle in the direction indicated by arrow 21 such that trailing end 14 of body 11 extends rearwardly with respect to the direction of travel. In fact, under most conditions of uniform motion, trailing end 14 is dragged along the underlying surface as toy vehicle 10 moves in the direction indicated by arrow 21.

Thus so long as toy vehicle 10 continues to be driven in the direction indicated by arrow 21, trailing end 14 of body 11 extends rearwardly and drags along the underlying surface. If however the rotation of wheels 15 and 16 is altered, a corresponding torque is applied to body 11 causing a corresponding rotation about the axles of wheels 15 and 16. For example, in the event wheels 15 and 16 are suddenly stopped, the stopping action applies a torque to body 11 in the direction indicated by arrow 29 lifting trailing end 14 from the underlying surface. More importantly with respect to the present invention, in the event toy vehicle 10 is stopped and wheels 15 and 16 are reversed and driven in the rotational direction indicated by arrow 28, the torque applied to wheels 15 and 16 in the direction indicated by arrow 28 applies a counter torque to body 11 in the direction indicated by arrow 29. As wheels 15 and 16 continue to be driven in the direction indicated by arrow 28, toy vehicle 10 begins moving in the direction indicated by arrow 39. As the torque continues to be applied to wheels 15 and 16, body 11 pivots in the direction indicated by arrow 29 raising trailing end 14 above wheels 15 and 16 in the manner shown in FIGS. 6A through 6D. Because of the continuing torque applied to wheels 15 and 16 during the reversal of direction, body 11 pivots completely about the shaft or center of rotation of wheels 15 and, 16 and reverses its position to trail wheels 15 and 16 (that is extend to the right in FIG. 1). Of importance with respect to the present invention is the offset support of body 11. Of further importance is the relatively short extension of front end 19 with respect to the diameters of wheels 15 and 16. Thus as body 11 pivots in the direction indicated by arrow 29 causing trailing end 14 to in essence "pass above and over" wheels 15 and 16, frontal end 19 pivots in the clockwise direction beneath the center of rotation of wheels 15 and 16 to eventually point to the left in the drawing of FIG. 1. As a result, it is important with respect to the present invention-that front end 19 define a shorter extension from the shaft axles and centers of rotation of wheels 15 and 16 to allow it to avoid contact with the underlying surface as it "passes beneath" the centers of rotation of wheels 15 and 16.

In the preferred fabrication of the present invention, body 11 is formed of a relatively lightweight strong material such as molded plastic or the like. Accordingly, trailing end 14 readily flips from one side to the other as the direction of wheel torque is reversed. This allows the user to cause toy vehicle 10 to behave in an interesting and somewhat erratic manner as the vehicle is driven back and forth across different surfaces reversing and counter reversing wheels 15 and 16. It will apparent to those skilled in the art from the foregoing operational description that body 11 responds rotationally to changes in torque applied to wheels 15 and 16. Thus as the user attains skill in operating the vehicle, a variety of maneuvers are attainable other than flipping trailing end 14 back and forth as the vehicle changes direction. Careful balancing of the torque applied to wheels 15 and 16 can produce a correspondingly fine rotational change of body 11. Having explained the tail flipping action of toy vehicle 10 under the assumption that vehicle 10 is driven in a straight line path and reversed in a straight line path, it will be apparent to those skilled in the art that the flipping action of body 11 is not limited to such straight line motion changes. On the contrary, body 11 responds to changes in wheel torque. Thus during curved or spinning maneuvers additional skill on the operator's part may cause body 11 to pivot or flip as desired.

Figure 2:
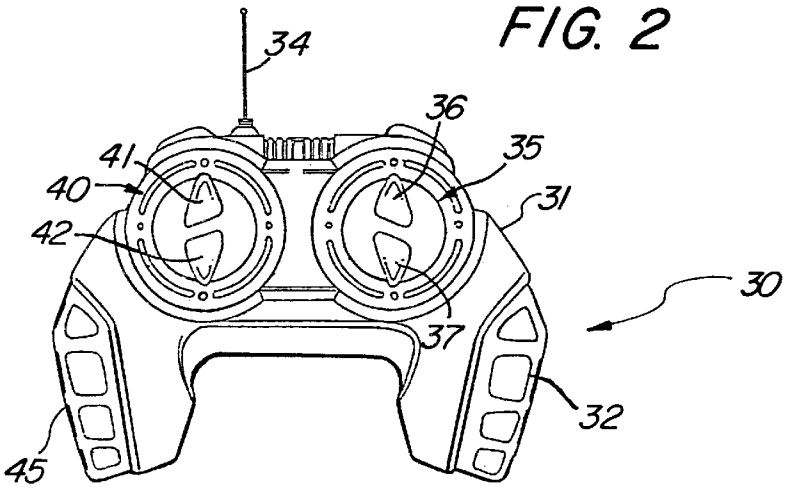
FIG. 2 sets forth a view as seen by the operator of a remote control transmitter unit for use in combination with the present invention toy vehicle.

FIG. 2 sets forth a control transmitter generally referenced by numeral 30 which may be fabricated entirely in accordance with conventional fabrication techniques. Thus transmitter 30 includes a body 31, preferably formed of a molded plastic material or the like, supporting a pair of wheel controls 35 and 40 and a transmitting antenna 34. Wheel control 35 includes a forward command button 36 and a reverse command button 37. Similarly, wheel control 40 includes a forward command button 41 and a reverse command button 42. Body 31 further defines convenient handles 32 and 33 to allow the user to grip control transmitter 30 and extend appendages such as the user's thumbs upwardly to manipulate wheel controls 35 and 40.

Figure 4:
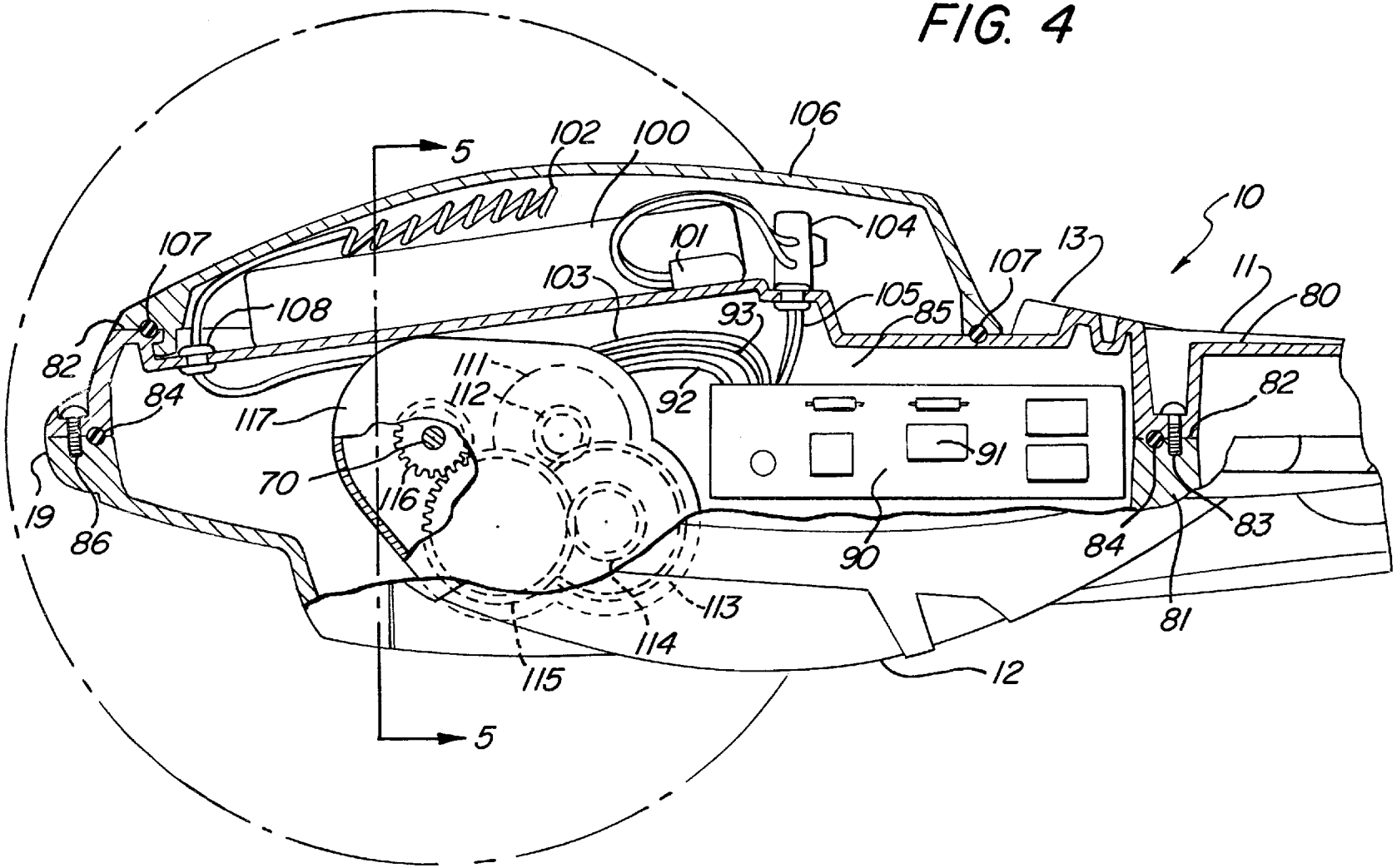
FIG. 4 sets forth a partial section view of the rear drive and control apparatus of the present invention toy vehicle.

In accordance with conventional fabrication techniques, control transmitter 30 includes a conventional electronic circuit for producing a radio frequency signal transmitted from antenna 34 to be received by a cooperating receiver and controller module 90 (seen in FIG. 4). This transmitting circuitry may be entirely conventional and is not shown. The essential characteristic of control transmitter 30 and receiver and controller module 90 (seen in FIG. 4) with respect to the present invention is the capability of providing a transmitted signal set which provides dual channel communication with the receiver and controller module within toy 10. This dual channel capability allows independent control of the drive units operating wheels 15 and 16 (seen in FIG. 1). For convenience of operation, wheel control 35 is dedicated to providing signals which control the rotational direction of wheel 15 while wheel control 40 is dedicated to providing signals which control wheel 16. It will be apparent that the reverse is, of course, equally convenient. A variety of well-known transmitting formats may be utilized to provide the dual channel capability referred to herein. For example, a single transmitter may operate on a time share basis in which commands from each of wheel controllers 35 and 40 are transmitted in a time interleaved signal pattern. More likely however the commands for wheel controllers 35 and 40 are transmitted on different carriers which may be easily frequency separated by receiver and control module 90 to allow independent commands to each of the drive units of wheels 15 and 16. A variety of other command formats may be utilized to operate control transmitter 30 and receiver and control module 90.

In operation, the user simply presses the desired forward or reverse buttons of each of the controllers to cause corresponding forward or reverse rotation of wheels 15 and 16.

In the absence of a button being pressed upon a wheel controller, wheels 15 and 16 stop.

Figure 3:
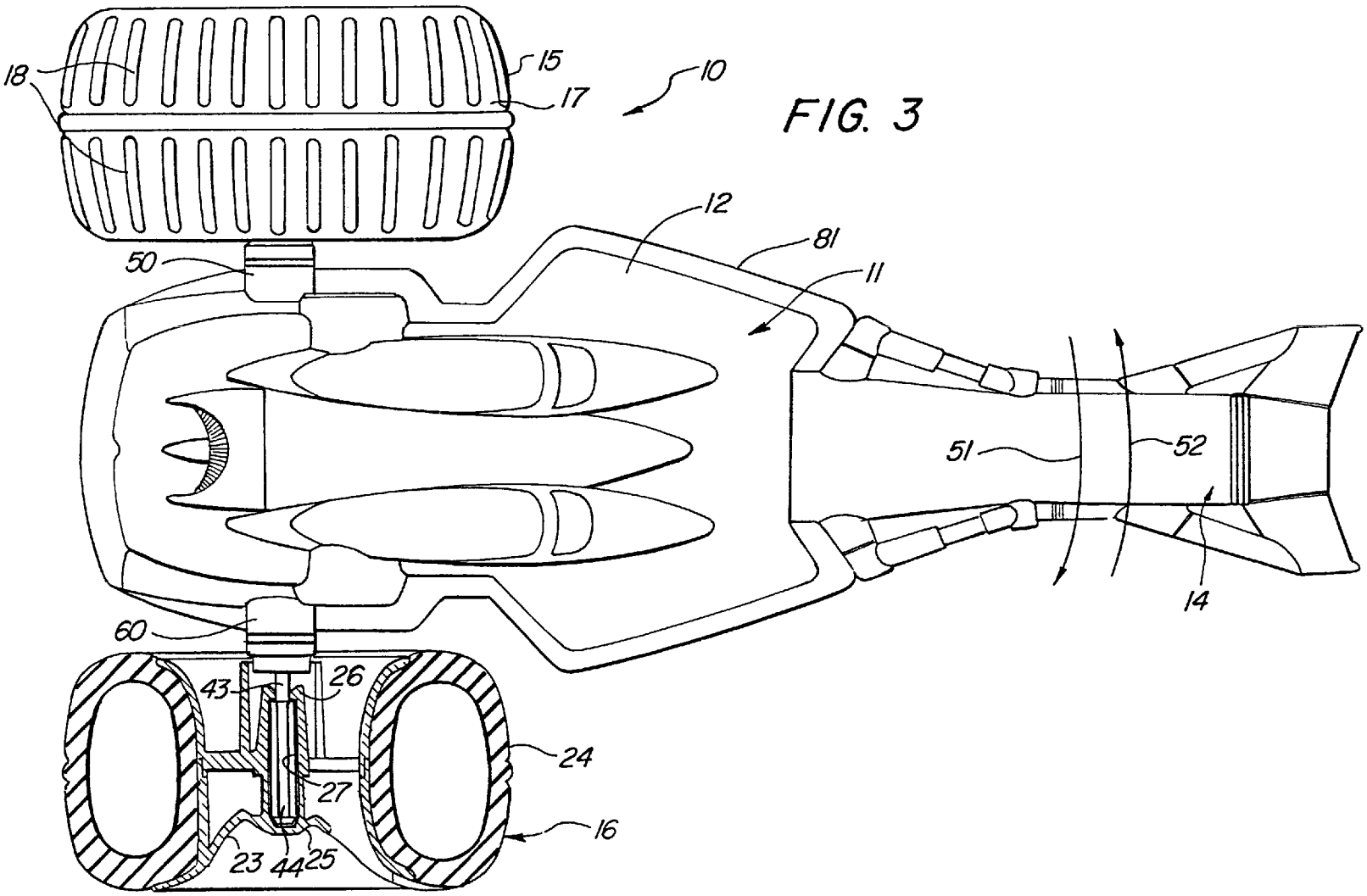
FIG. 3 sets forth a partially sectioned top view of the present invention toy vehicle.

FIG. 3 sets forth a top view of toy vehicle 10 showing wheel 16 and its supporting apparatus in section view. As described above, toy vehicle 10 includes a body 11 formed of a top half body 81 defining a multiply contoured top side 12. Body 11 further defines an elongated trailing end 14 and a shortened frontal end 19. Body 11 is supported by a pair of wheels 15 and 16. Wheels 15 and 16 include respective tires 17 and 24. Each of tires 17 and 24 defines a plurality of traction ribs 18. In the preferred fabrication of the present invention, tires 17 and 24 are fabricated from a high friction material such as molded plastic or rubber. In accordance with the user's choice, tires 17 and 24 may be fabricated as either solid material tires having a resilient character or may be pneumatic air filled tires also formed of a resilient material. Body 11 defines a pair of shaft guides 50 and 60 extending outwardly which receive respective axle shafts 43 and 70 (the latter seen in FIG. 5). Wheel 16 includes a wheel rim 23 defining a faceted recess 27 therein. Recess 27 is surrounded by a resilient clasp 26. Wheel rim 23 further supports tire 24 to complete wheel 16. Shaft 43 further supports a faceted end 44 which is received within recess 27 during the initial assembly of wheel 16 to axle shaft 43. This assembly is carried forward in a simple one time snap-fit attachment by forcing the tapered end of faceted end 44 through clasp 26. Because of the resilient material from which clasp 26 is formed, the clasp deforms and spreads outwardly allowing faceted end 44 to be inserted into recess 27. The respective facets within recess 27 and faceted end 44 cause faceted end 44 to engage recess 27 and wheel rim 23. Once faceted end 44 is fully inserted within recess 27, clasp 26 again snaps back or reforms to the configuration shown in FIG. 3 captivating wheel rim 23 upon faceted end 44. It will be understood by those skilled in the art that wheel 15 and tire 17 thereof are supported in an identical fashion using an identical structure including a faceted end 71 upon shaft 70 (seen in FIG. 5).

Figure 5:
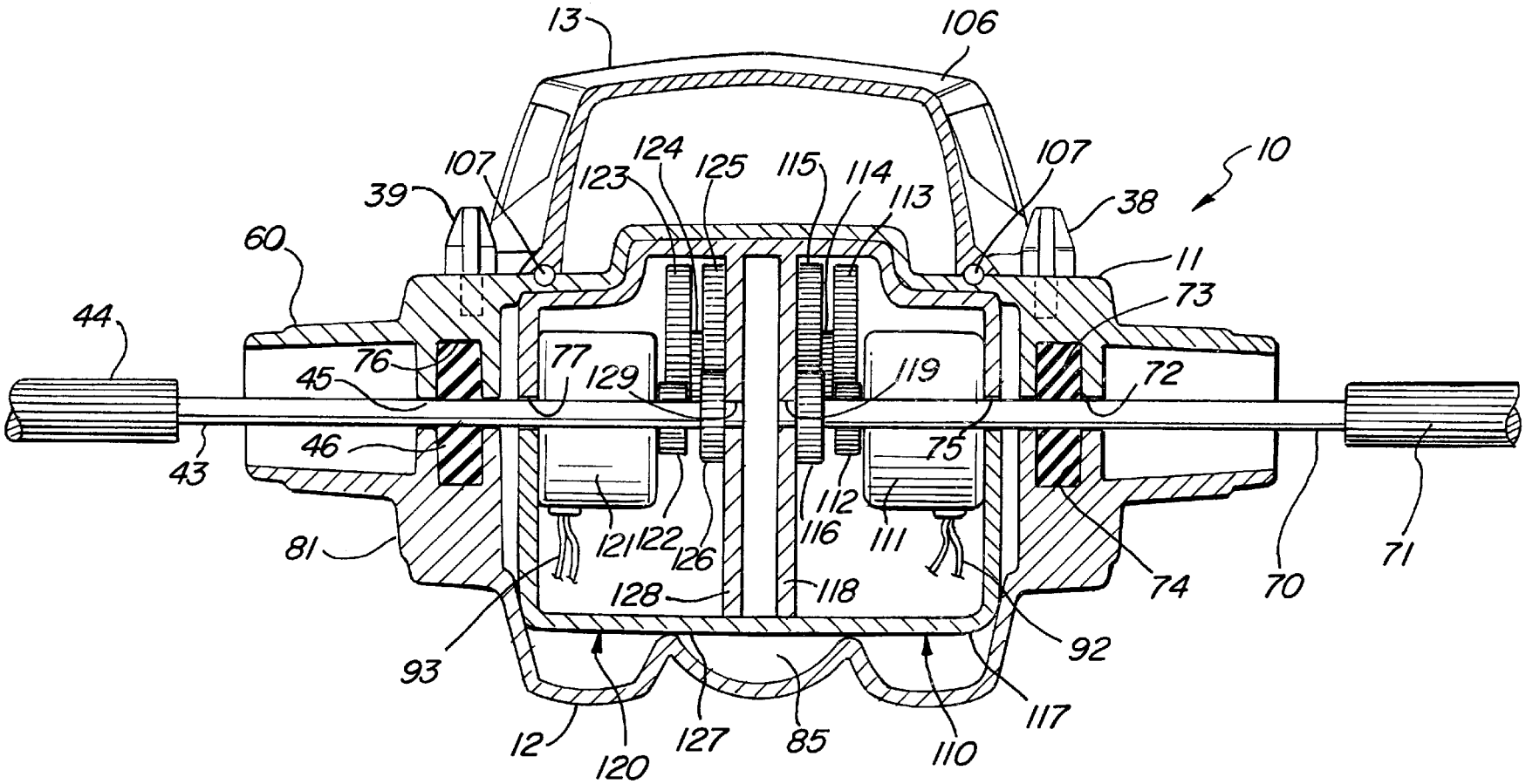
FIG. 5 sets forth a partial section view of the present invention toy vehicle taken along section lines 5—5 in FIG. 4.

As is seen in FIG. 5 below, wheels 15 and 16 are independently driven in the above-described differential drive system which allows toy vehicle 10 to be steered in either direction or travel a straight line path in either direction. In addition, the variation of relative speed of rotation between wheels 15 and 16 may be utilized to provide spinning and rapid rotating motions of toy vehicle 10 in addition to simple curved path variations of travel. By manipulating wheel speed and direction of rotation skillfully, the operator is able to drive toy vehicle 10 through virtually any path and cause it to perform various tricks and stunts. One such stunt is set forth below in FIGS. 7A through 7C in which toy vehicle 10 may be operated to perform a one wheel spinning wheel stand. With respect to differential steering of toy vehicle 10, it will be apparent to those skilled in the art that rotation of wheel 15 at a greater speed than wheel 16 causes body 11 to pivot in the direction indicated by arrow 52 as toy vehicle 10 executes a left hand turn. Conversely rotating wheel 16 faster than wheel 15 produces a pivoting of body 11 in the direction indicated by arrow 51 causing toy vehicle 10 to execute a left turn.

FIG. 4 sets forth a partially sectioned side view of body 11 showing the battery power module, the receiver and controller module, and the drive unit operative upon wheel 15. With temporary reference to FIG. 5, it will be noted that identical mirror image drive units are provided within body 11 for each of wheels 15 and 16. It should also be noted that toy vehicle 10 is shown in FIG. 4 having body 11 inverted from the position shown in FIG. 1. As described above, body 11 is formed of a top half body 81 and a bottom half body 80 joined along a common interface 82. Interface 82 further supports a resilient seal 84 which is positioned between half bodies 80 and 81 to provide a sealed enclosure for interior cavity 85. A plurality of fasteners such as fasteners 83 and 86 secure half body 80 to half body 81. Body 11 further defines a battery cover 106 secured to the surface of bottom half body 80 by a plurality of latches such as latches 38 and 39 shown in FIG. 5. These 49 latches are simple rotating latches which force battery cover 106 downwardly against seal 107 positioned between the edge of battery cover 106 and the underlying surface of bottom half body 80. A battery module 100 which may, for example, comprise a single 9 volt conventional battery or alternatively utilize a plurality of batteries is supported within the interior of battery cover 106. A receiver and control module 90 fabricated in accordance with conventional fabrication techniques includes conventional radio frequency signal receiving apparatus together with command decoding apparatus and motor control elements all of which may be fabricated in accordance with conventional fabrication techniques. Accordingly, receiver and controller module 90 supports a plurality of electronic components such as integrated circuit 91 and is coupled by a pair of power connecting lines 105 to a connector 104 which in turn is coupled to connector 101 of battery module 100 to supply operative power for the motor drive apparatus and receiver and controller module 90. Receiver and controller module 90 includes an antenna wire 103 which extends through a sealing grommet 108 and extends into the interior of battery cover 106 to form an antenna 102. Antenna 102 functions to receive radio frequency transmissions from control transmitter 30 in accordance with conventional fabrication techniques. A motor drive unit 110 is supported within interior cavity 85 of body 11 in the manner shown in FIG. 5. Drive unit 110 includes a housing 117 within which a reversible DC motor 111 is supported. Motor 111 is operatively coupled to an output gear 112 which in turn engages a gear 113. Gear 113 is a compound gear having a smaller gear 114 which rotates as gear 112 drives gear 113. Gear 114 engages a further gear 115 which in turn engages a shaft output gear.116. The latter is secured to axle shaft 70 such that rotation of gear 116 produces a corresponding rotation of axle shaft 70. The combination of gears 112 through 116 comprises a gear set or gear train generally referred to as a speed reduction transmission. Thus motor 111 is able to operate at a substantially higher RPM than shaft 70 and enjoys the torque multiplication advantage which such speed reduction gears provide. A pair of electrical connections within cable 92 are coupled between receiver and controller module 90 and motor 111 by conventional means (not shown).

As is better seen in FIG. 5, toy vehicle 10 includes a motor drive unit 120 which is identical in operation and which is a mirror image of drive unit 110. Thus it will be understood by those skilled in the art that the description of drive unit 110 applies equally well and is equally descriptive of drive unit 120. Accordingly an additional wire set 93 is coupled between drive unit 120 (seen in FIG. 5) and receiver and controller module 90.

In operation the above-described manipulation of control transmitter 30 set forth in FIG. 2 produces radio frequency control signals having dual channel or dual communication capability and formatting which are received by antenna 102 and produce corresponding electrical signals applied to receiver and controller module 90. Receiver and controller module 90 is configured to be compatible with the format and system utilized in control transmitter 30 (seen in FIG. 2). Thus receiver and controller module 90 operating entirely in accordance with conventional fabrication techniques, decodes the received signals from the control transmitter and applies appropriate operating power to motors 111 and 121 to achieve the desired rotational speed and direction for each of wheels 15 and 16.

FIG. 5 sets forth a partial section view of toy vehicle 10 taken along section lines 5—5 in FIG. 4. Once again it should be mentioned that toy vehicle 10 is inverted in FIG. 5 from the position shown in FIG. 1. It will be recalled that in accordance with the present invention toy vehicle 10 operates with either the body orientation of FIG. 1 or the inverted body orientation of FIGS. 4 and 5. Accordingly, and as described above, toy vehicle 10 includes a molded plastic body 11 formed of a top half body 81 and a bottom half body 80 joined along a common interface in the manner shown in FIG. 4. As is also described above, body 11 forms an interior cavity 85 within which a pair of drive units 110 and 120 are supported in respective housings 117 and 127. Housings 117 and 127 are shown formed in a common unit having interior walls separating each drive unit. Also it should be noted that the interior surfaces of body 11 within interior cavity 85 support and captivate the combination of housings 117 and 127.

As is also described above, body 11 includes a removable battery cover 106 secured to body 11 by a plurality of pivoting latches such as latches 38 and 39. As is also described above, a resilient seal 107 is supported between the edge of battery cover 106 and the underlying portion of body 11. While not shown in FIG. 5 to avoid cluttering the figure, it will be recalled that battery module 100 is supported within battery cover 106 together with antenna 102 in the manner seen in FIG. 4.

Body 11 further defines a pair of outwardly extending, generally cylindrical shaft guides 50 and 60. Body 11 further defines a bore 72 extending inwardly from shaft guide 50. Body 11 further defines an annular groove 74 which receives and captivates a resilient seal 73. Similarly, body 11 defines a bore 45 extending inwardly from shaft guide 60 together with an annular groove 76. Groove 76 supports and captivates a resilient seal 46.

Housing 117 of drive unit 110 defines an interior wall 118 having an aperture 119 therein. Housing 117 further defines an aperture 75 aligned with bore 72 of body 11 and aperture 119 of wall 118. Drive unit 110 further includes a reversible DC motor 111 operatively coupled to receiver and controller module 90 (seen in FIG. 4) by a plurality of connecting wires 92. Motor 110 includes an output gear 112. A gear 113 having a smaller gear 114 joined thereto engages gear 112 and is rotatably supported within housing 117 by conventional means not shown. A gear 115 also rotatably supported by conventional means within housing 117 engages gear 114 and further engages a shaft gear 116. An axle shaft 70 having a faceted end 71 extends inwardly through shaft guide 50 and bore 72 of body 11 and aperture 75 of housing 117. The interior end of shaft 70 is rotatably supported within aperture 119 of interior wall 118. Shaft output gear 116 is secured to shaft 70. Seal 73 is annular and is tightly fitted to shaft 70 to provide a liquid tight seal thereof which permits shaft 70 to rotate while preventing liquid penetration of body 11 through bore 72.

As mentioned above, drive unit 120 is identical in structure and presents a mirror image of drive unit 110. Accordingly, drive unit 120 is supported within a housing 127 having apertures 77 and 129 formed therein. Drive unit 120 includes a reversible DC motor 121 coupled to receiver and controller module 90 (seen in FIG. 4) by a connecting wire set 93. Motor 121 supports an output gear 122 which engages a gear 123. The latter includes a gear 124 joined thereto which engages a gear 125. Gears 123, 124, and 125 are rotatably supported within housing 127 by conventional means (not shown). Gear 125 further engages shaft gear 126.

Axle shaft 43 having a faceted end 44 formed thereon extends inwardly through bore 45 and apertures 77 and 129 of housing 127. The interior end of axle shaft 43 is secured to axle gear 126. The attachment of axle gears 116 and 126 to their respective axle shafts may utilize conventional fabrication techniques such as adhesive or sonic welding or the like. The important aspect of this attachment is that rotation of the shaft gears produces a corresponding torque and rotation of their respective axle shafts. Resilient seal 46 supported within groove 76 defines an annular member which provides a rotational seal upon axle shaft 43 and prevents liquid intrusion into interior cavity 85 of body 11.

In operation, as receiver and controller module 90 (seen in FIG. 4) applies appropriate energizing power to motors 111 and 121 via connecting wire sets 92 and 93, respectively, drive gears 112 and 122 are rotated under motor power. The rotational power of drive gears 112 and 122 is coupled through respective speed reduction power gain gear sets to rotate shaft gears 116 and 126, respectively. The rotation of shaft gears 116 and 126 produces a corresponding rotation of axle shafts 70 and 43, respectively, which as described above, are coupled to wheels 15 and 16 through faceted ends 71 and 44. Thus as power is applied at a given power level and polarity to motors 111 and 121, wheels 15 and 16 (seen in FIG. 3) are appropriately rotated to provide the above-described performance of toy vehicle 10.

FIGS. 6A through 6D set forth simplified diagrams of toy vehicle 10 in operation in sequence as toy vehicle 10 performs the above-described body flipping action. More specifically, in FIG. 6A, toy vehicle 10 is shown moving across a surface 65 in the direction indicated by arrow 21. As described above, toy vehicle 10 includes a pair of wheels 15 and 16 rotationally coupled to a body 11. Body 11 defines a trailing end 14, a top side 12 and a bottom side 13. A center of rotation 66 is shown at the center of wheels 15 and 16 which will be understood to correspond to the position with respect to wheels 15 and 16 as well as body 11 occupied by axle shafts 43 and 70 (seen in FIG. 5). Thus in the orientation shown in FIG. 6A, toy vehicle 10 is powered to rotate wheels 15 and 16 in the direction indicated by arrow 20. A corresponding counter torque or reaction torque is applied as a result to body 11 in the direction indicated by arrow 22. Thus toy vehicle 10 moves along surface 65 in the direction indicated by arrow 21 with trailing end 14 of body 11 dragging along surface 65.

Figure 6A:
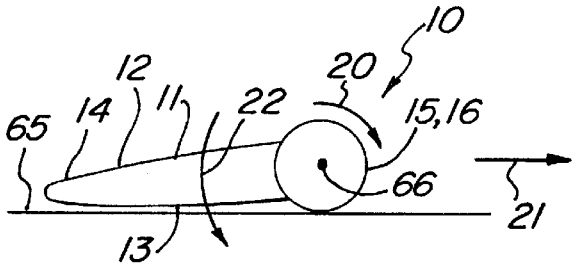
FIGS. 6A through 6D set forth sequential side views of the body flipping and direction changing of the present invention toy vehicle.
Figure 6B:
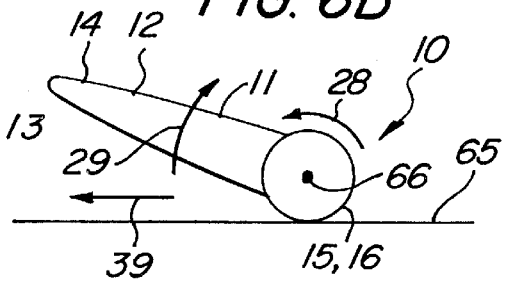

FIG. 6B shows the orientation of toy vehicle 10 upon surface 65 as the operator reverses the direction of torque applied to wheels 15 and 16. As a result, wheels 15 and 16 reverse direction and rotate in the direction indicated by arrow 28. This begins to drive toy vehicle 10 in the direction indicated by arrow 39. The reaction torque or counter torque applied to body 11 as a result of the torque reversal to wheels 15 and 16 acts in the direction indicated by arrow 29. As a result, body 11 pivots upwardly raising trailing end 14 in a pivotal motion about center of rotation 66.

Figure 6C:
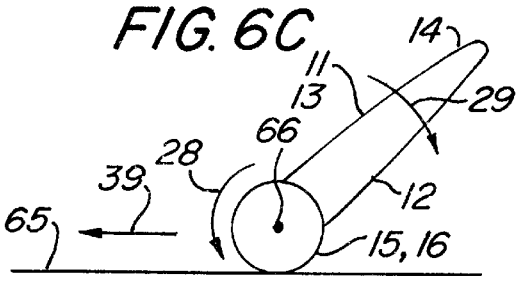

FIG. 6C shows the continuation of the flipping action initiated in Figure B. Accordingly, as wheels 15 and 16 continue to be driven in the direction indicated by arrow 28, toy vehicle 10 continues to move along surface 65 in the direction indicated by arrow 69. The continuing torque applied to body 11 in the direction indicated by arrow 29 continues to pivot body 11 about center of rotation 66.

Figure 6D:
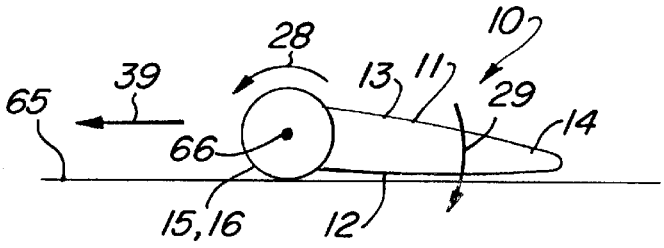

FIG. 6D shows the completion of the flipping action of toy vehicle 10 as wheels 15 and 16 continue to rotate in the direction indicated by arrow 28 moving toy vehicle 10 in the direction of arrow 39. The combination of gravity and reaction torque applied to body 11 pivots body 11 downwardly in the direction indicated by arrow 29 about center of rotation 66 substantially completing the reorientation of toy vehicle 10 for travel in the reverse direction from that shown in FIG. 6A. Thereafter, as toy vehicle 10 moves in the direction indicated by arrow 39, trailing end 14 drops into contact with surface 65 and drags across surface 65 as the toy vehicle is driven. comparison of FIGS. 6A and 6D shows that the direction reversal of toy vehicle 10 has inverted body 11. It will be apparent to those skilled in the art that a reversal once again of wheels 15 and 16 produces a corresponding flipping action in which body 11 is pivoted counterclockwise and returns to the orientation shown in FIG. 6A.

Figure 7A:
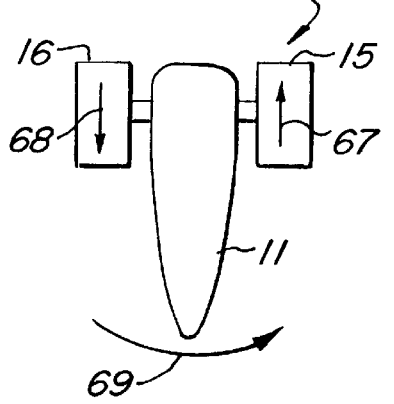
FIGS. 7A through 7C set forth sequential top views of the one wheel spin action of the present invention toy vehicle.
Figure 7B:
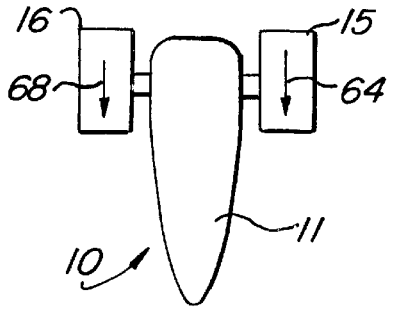
Figure 7C:
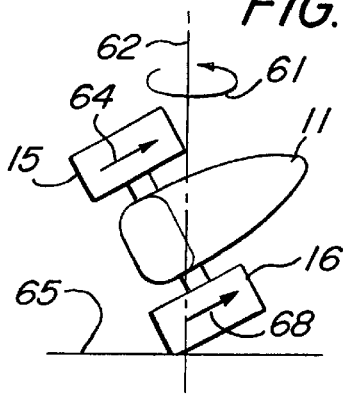

FIGS. 7A through 7C set forth simplified sequential diagrams showing the novel one wheel spin action executable by the present invention toy vehicle. FIG. 7A sets forth a top view of toy vehicle 10 operating upon an underlying surface such as surface 65 shown in FIG. 6A. In accordance with the above-described differential operation of wheels 15 and 16, the user initiates a spinning action of body 11 in the direction indicated by arrow 69 by rotating wheel 15 in the direction indicated by arrow 67 and wheel 16 in the opposite direction indicated by arrow 68. The result is a horizontal flat spin of toy vehicle 10 in the direction indicated by arrow 69 upon the underlying surface.

FIG. 7B illustrates the initial step in converting the horizontal spin of toy vehicle 10 upon the underlying surface to the one wheel spin shown in FIG. 7C. The operation shown in FIG. 7B initiates the one wheel spin as the operator continues to rotate wheel 16 in the direction indicated by arrow 68 while abruptly and instantaneously reversing the direction of rotation of wheel 15 to the direction indicated by arrow 64. This instantaneous or abrupt reversal of wheel 15 and its subsequent opposite direction motion causes wheel 15 to function as a gyro for stabilizing the rotation of body 11 and wheel 16 about a substantially vertical axis (shown as axis 62 in FIG. 7C). Thus wheel 15 is lifted by this gyroscopic action and toy vehicle 10 assumes the one wheel spin shown in FIG. 7C.

FIG. 7C shows the stable rotation on wheel 16 of toy vehicle 10. Toy vehicle 10 rotates body 11 and wheel 15 about a substantially vertical axis 62 in the direction indicated by arrow 61. As wheel 16 continues to rotate in the direction indicated by arrow 68 and wheel 15 continues to rotate in the direction indicated by arrow 64, this one wheel rotation continues in a substantially stable rotation which is highly entertaining and amusing.

Experience has shown that it requires some degree of skill and timing to achieve the stable one wheel rotation described in FIGS. 7A through 7C. However this presents an increased amusement and challenge to the user and has been found to greatly enhance the attractiveness of the present invention two-wheeled amphibious toy vehicle. Once the rotation of either wheel 15 or 16 is disturbed from the equilibrium established during one wheel rotation, the toy vehicle then immediately collapses to either the position shown in FIG. 6A or the inverted position shown in FIG. 6D.

Returning to FIG. 1, it will be noted that wheel 15 (and its identical wheel 16) define various features such as notches 55 as well as spoke-like features 56. Further with reference to FIG. 3, it should be recalled that tires 17 and 24 define a plurality of outer ribs 18 spaced about their tread portions. The combination of such contour features and ribs provides wheels 15 and 16 with an additional capability when toy vehicle 10 is placed within a water environment. The hollow sealed character of body 11 and the lightweight plastic material from which it is formed facilitates the floatation of toy vehicle 10 upon the water surface. The contoured and multiply featured outer surfaces of wheels 15 and 16 allow a "paddle wheel" effect to be achieved as the wheels are rotated within the water. As a result, the present invention toy vehicle is truly amphibious in that it will perform either upon an underlying dry surface or when floating upon the surface of a body of water. In each event, the propulsion of the toy vehicle is achieved by rotation of wheels 15 and 16. To best facilitate the operation of toy vehicle 10 in an aquatic environment, it has been found optimum to fabricate wheels 15 and 16 using hollow pneumatic tires rather than solid material tires. However solid material tires formed of a sufficiently lightweight material may also be used.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. A remotely controlled toy comprising:

an elongated body having a front end and a trailing end, said trailing end being free of any wheels;

a pair of wheels rotatably supported by said body substantially closer to said frontal end and farther from said trailing end, said pair of wheels being supported at a position on said body which causes said toy to be supported upon said wheels and said trailing end;

drive means for independently rotating each of said wheels in either direction of rotation said drive means having first and second drive units each operatively coupled to one of said wheels and each having second reversible motors, responsive to said control means, and first and second speed reduction gear combinations and wherein said wheels each include an axle shaft coupling each of said wheels to a respective one of said first and second gear combinations; and control means for operating said drive means in accordance with user commands to move said toy upon a surface on said wheels dragging said trailing end upon a surface; and wherein said wheels define equal radii and wherein said frontal end extends forwardly of said axle shafts a distance less than said wheels radii.

2. The remotely controlled toy set forth in claim 1 wherein said control means includes:

a remote transmitter, operable by a user, for transmitting commands in response to user inputs; and a receiver and controller, supported within said body, for receiving transmitted commands and controlling said first and second motors in accordance therewith.

3. The remotely controlled toy set forth in claim 2 wherein said wheels each define surface contours and wherein said body and said wheels are buoyant in water, said surface contours allowing said wheels to propel said toy through water as they rotate.

4. The remotely controlled toy set forth in claim 3 wherein said body is formed of a pair of mating half bodies joined along a mutual interface.

5. A toy vehicle comprising:

an elongated body having frontal end and a trailing end, said trailing end being free of wheels;

a pair of wheels rotatably coupled to each side of said elongated body close to said frontal end such that said wheels extend beyond said frontal end and said trailing end extends well beyond said wheels and such that said toy vehicle is supported upon a surface by said wheels and said trailing end; and means for independently and reversibly rotating said wheels to propel said toy vehicle, said toy vehicle moving in a first direction of motion as said wheels rotate in a first rotational direction such that said trailing end extends rearwardly with respect to said first direction of motion and said body pivoting when said wheels are reversed to a second opposite direction of rotation propelling said vehicle in a second opposite direction of motion to extend rearwardly with respect to said second direction of motion.

6. The toy vehicle set forth in claim 5, further including a remote control transmitter for transmitting command signals and wherein said means for independently rotating said wheels includes means for receiving said transmitted command signals and rotating said wheels in response to said commands.

* * * * *